US012578148B2

(12) United States Patent
Kurosawa et al.

(10) Patent No.: US 12,578,148 B2
(45) Date of Patent: Mar. 17, 2026

(54) HEAT EXCHANGER AND METHOD FOR MANUFACTURING THE SAME

(71) Applicant: HONDA MOTOR CO., LTD., Tokyo (JP)

(72) Inventors: Yuta Kurosawa, Saitama (JP); Tsuneo Endo, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 114 days.

(21) Appl. No.: 18/615,491

(22) Filed: Mar. 25, 2024

(65) Prior Publication Data

US 2024/0328716 A1 Oct. 3, 2024

(30) Foreign Application Priority Data

Mar. 27, 2023 (JP) ..... 2023-049899

(51) Int. Cl.
*F28D 1/053* (2006.01)
*F28F 1/02* (2006.01)

(52) U.S. Cl.
CPC ..... *F28D 1/05391* (2013.01); *F28F 1/022* (2013.01)

(58) Field of Classification Search
CPC ..... B33Y 80/00; F28F 9/26; F28D 1/05391
See application file for complete search history.

(56) References Cited

U.S. PATENT DOCUMENTS

2005/0067153 A1* 3/2005 Wu ..... F28F 9/0221 165/158
2016/0116222 A1* 4/2016 Shedd ..... F28F 1/36 165/166
2017/0198977 A1* 7/2017 Herring ..... F28F 9/02
2017/0335690 A1* 11/2017 Golan ..... F28D 7/1684
2017/0363361 A1* 12/2017 Turney ..... F28D 7/0025
2019/0024987 A1* 1/2019 Moore ..... F28F 3/02
2021/0102756 A1* 4/2021 Becene ..... F28F 7/02
2021/0270534 A1* 9/2021 Erno ..... F28D 7/005
2021/0381473 A1* 12/2021 Endou ..... F28F 1/025

FOREIGN PATENT DOCUMENTS

DE 202012012919 U1 * 4/2014 ..... F28D 9/0037
JP 2021-188872 A 12/2021

OTHER PUBLICATIONS

Translation of DE202012012919U1 named Translation-DE202012012919U1 (Year: 2014).*

* cited by examiner

*Primary Examiner* — Paul Alvare
(74) *Attorney, Agent, or Firm* — Paratus Law Group, PLLC

(57) ABSTRACT

A heat exchanger includes: a core portion; a first refrigerant flow path; and a second refrigerant flow path as defined herein, the first refrigerant flow path includes a plurality of first main flow paths as defined herein, the second refrigerant flow path includes a plurality of second main flow paths extending in the first direction and arranged in the second direction, the plurality of second main flow paths arranged in the second direction are formed by being surrounded by the partition wall constituting the first main flow path, and are provided in each of a plurality of rows arranged in the third direction, the core portion is formed by joining a plurality of units, and the first main flow path of each of the plurality of units is a region closed by the partition wall in a cross section viewed from the first direction.

3 Claims, 11 Drawing Sheets

HEAT EXCHANGER AND METHOD FOR MANUFACTURING THE SAME

CROSS-REFERENCE TO RELATED APPLICATION

This application is based on and claims priority under 35 USC 119 from Japanese Patent Application No. 2023-049899 filed on Mar. 27, 2023.

TECHNICAL FIELD

The present invention relates to a heat exchanger and a method for manufacturing the same.

BACKGROUND ART

Heat exchangers using various heat transfer methods have been widely used as devices for transferring heat between two fluids having different temperatures.

In recent years, researches and developments have been actively conducted that contribute to improvement in energy efficiency in order to allow more people to access affordable, reliable, sustainable and advanced energy. In a heat exchanger, improvement in heat exchange efficiency is required in order to contribute to improvement in energy efficiency.

Further, recently, a technique related to an additive manufacturing method of forming a shape by additive manufacturing a material has progressed, and by using the additive manufacturing method, it is possible to manufacture a product having a complicated three-dimensional shape which is difficult to form using conventional cutting, forging, punching, and the like. Also for the heat exchanger, it is possible to manufacture a heat exchanger having a complicated three-dimensional shape by manufacturing using the additive manufacturing method. JP2021-188872A describes a heat exchanger that is not only lightweight and cost-reduced but also has a new function by being manufactured using an additive manufacturing method.

SUMMARY OF INVENTION

When a heat exchanger is manufactured by an additive manufacturing method of forming a shape by additive manufacturing a material as in the heat exchanger described in JP2021-188872A, it is possible to form a complicated three-dimensional shape, but there is a problem that there is a limit to an increase in size depending on a size of manufacturing equipment used by the additive manufacturing method or the like, and the number of times of lamination increases, resulting in a very long manufacturing time. Therefore, a method can be considered in which a heat exchanger is divided into a plurality of units, each unit is manufactured, and then the units are joined to manufacture the heat exchanger.

However, in this case, when a positional deviation occurs at the time of joining the units or an error occurs in a dimension of a cooling water flow path or an air flow path at the time of manufacturing the units, the cooling water flow path and the air flow path may communicate with each other, and cooling water and air may be mixed inside the heat exchanger.

The present invention provides a heat exchanger that can be easily increased in size without deterioration in quality, and a method for manufacturing the same.

The present invention relates to a heat exchanger, including:

a core portion;

a first refrigerant flow path provided in the core portion and configured to allow a first fluid to flow therethrough; and a second refrigerant flow path provided in the core portion and configured to allow a second fluid to flow therethrough, in which in the core portion, the first fluid flowing through the first refrigerant flow path and the second fluid flowing through the second refrigerant flow path exchange heat via a partition wall, the first refrigerant flow path includes a plurality of first main flow paths extending in a first direction and arranged in a second direction perpendicular to the first direction, the plurality of first main flow paths arranged in the second direction are provided in a plurality of rows arranged in a third direction orthogonal to both the first direction and the second direction, the second refrigerant flow path includes a plurality of second main flow paths extending in the first direction and arranged in the second direction, the plurality of second main flow paths arranged in the second direction are formed by being surrounded by the partition wall constituting the first main flow path, and are provided in a plurality of rows arranged in the third direction, the core portion is formed by joining a plurality of units, and the first main flow path of each of the units is a region closed by the partition wall in a cross section viewed from the first direction.

In addition, the present invention relates to a method for manufacturing the above heat exchanger, the method including:

forming a plurality of the units by additive manufacturing a material; and joining the plurality of units to form the core portion.

According to the present invention, even if a positional deviation occurs at the time of joining the units or an error occurs in a dimension of the first main flow path at the time of manufacturing the units, the units can be joined such that a first refrigerant flowing through the first main flow path and a second refrigerant flowing through the second main flow path are not mixed, and thus the heat exchanger can be easily increased in size without deterioration in quality.

DETAILED DESCRIPTION OF THE INVENTION

Figure 1:
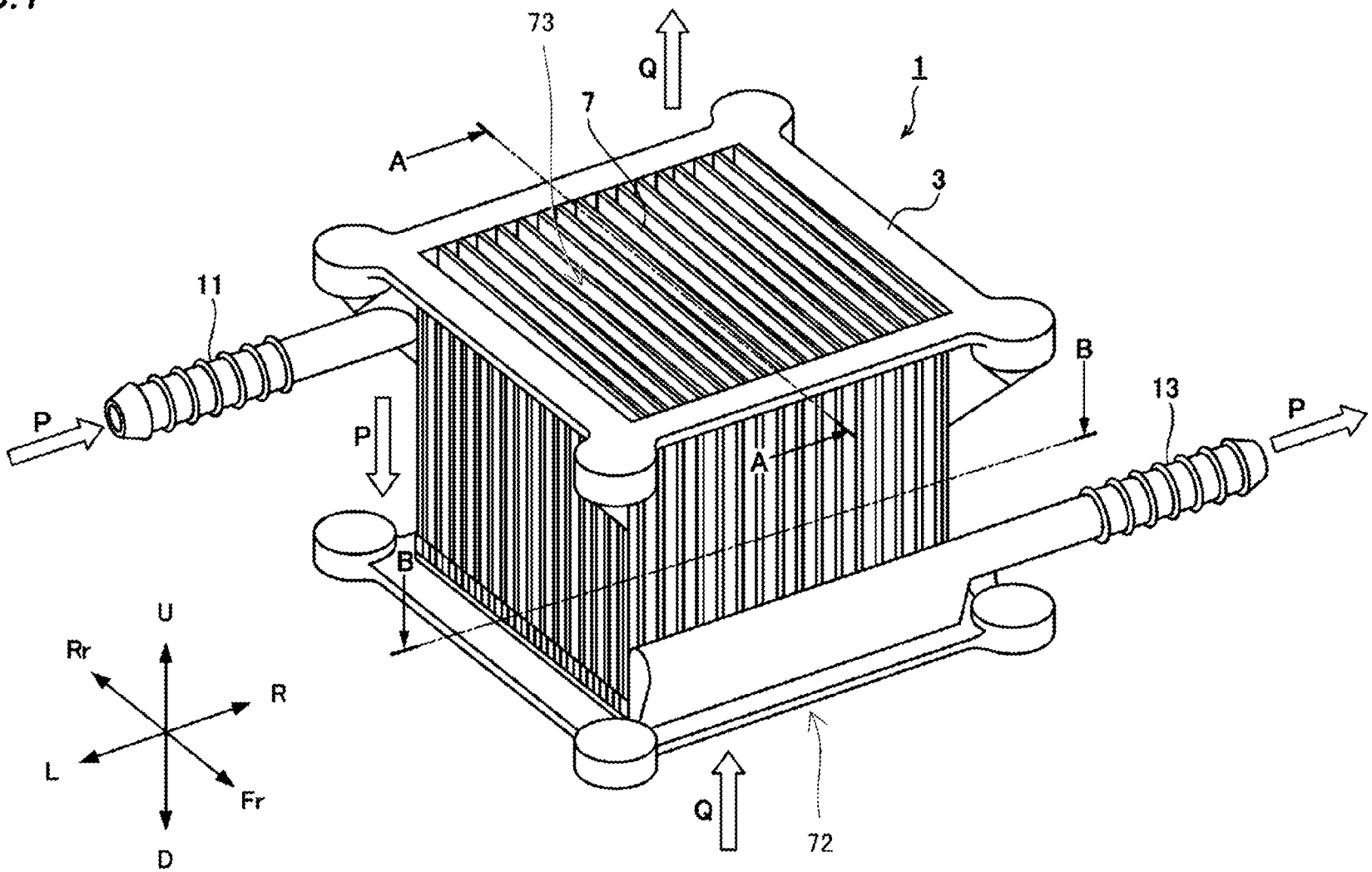
FIG. 1 is a perspective view of a radiator 1.

Hereinafter, an embodiment of a heat exchanger according to the present invention will be described with reference to the accompanying drawings. The drawings are viewed in directions of reference numerals. The heat exchanger is a device that allows a first fluid to be cooled and a second fluid that cools the first fluid to exchange heat via a partition wall. Properties of the first fluid and the second fluid are not particularly limited, and include all combinations such as gases, liquids, and gases and liquids. The first fluid and the second fluid are, for example, water, oil, an organic medium, air, or helium gas. In addition, a device on which the heat exchanger is mounted is not particularly limited, and includes all products such as a vehicle, a general-purpose device, an aircraft, and a home appliance. In the following embodiment, a radiator mounted on a vehicle will be described as an example of the heat exchanger according to the present invention. That is, in the following embodiment, the first fluid is cooling water for cooling a drive source of a vehicle, and the second fluid is air (traveling wind).

Figure 2:
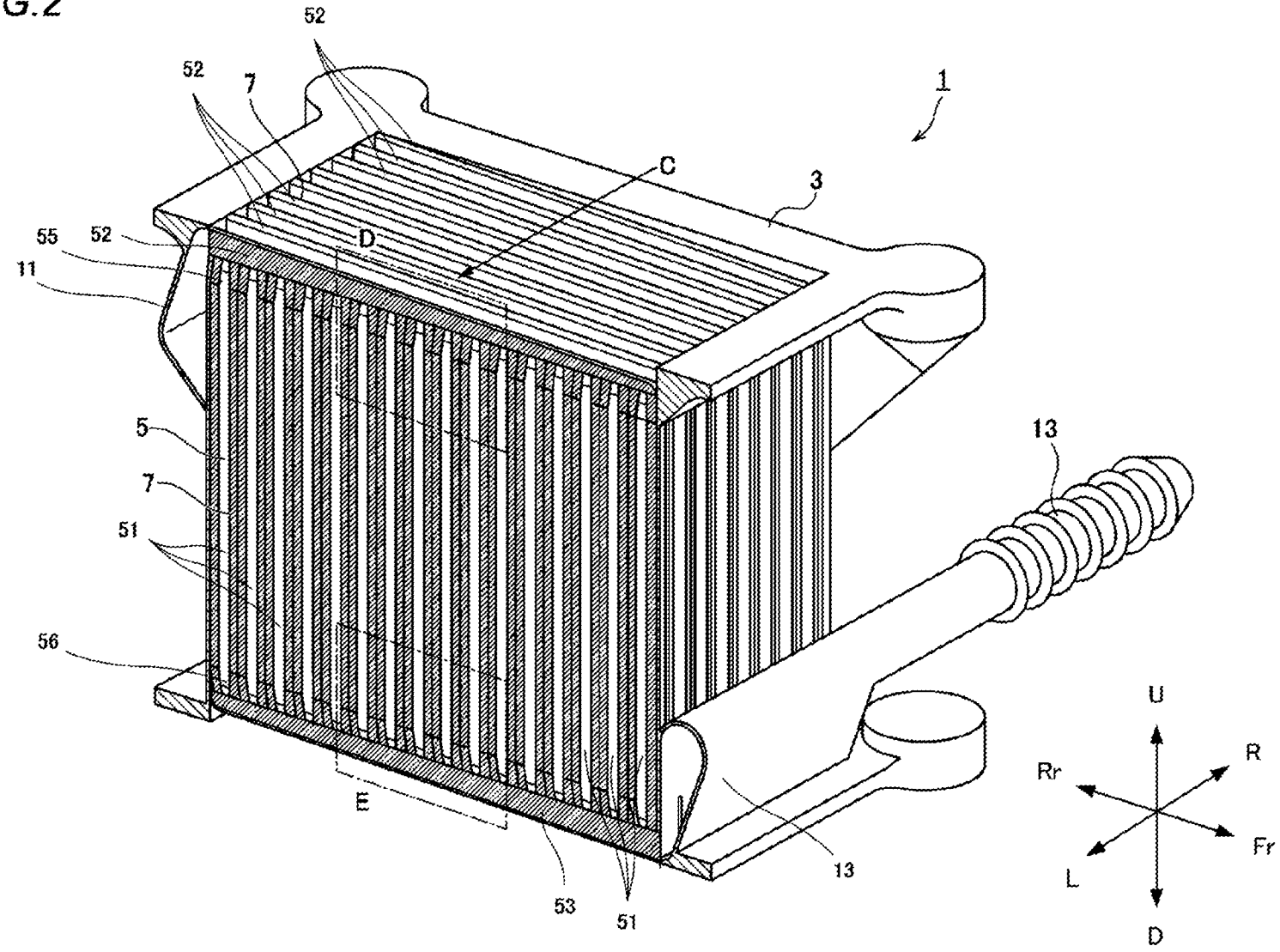
FIG. 2 is a partial perspective view in which a cross section along a line A-A in FIG. 1 is exposed.
Figure 3:
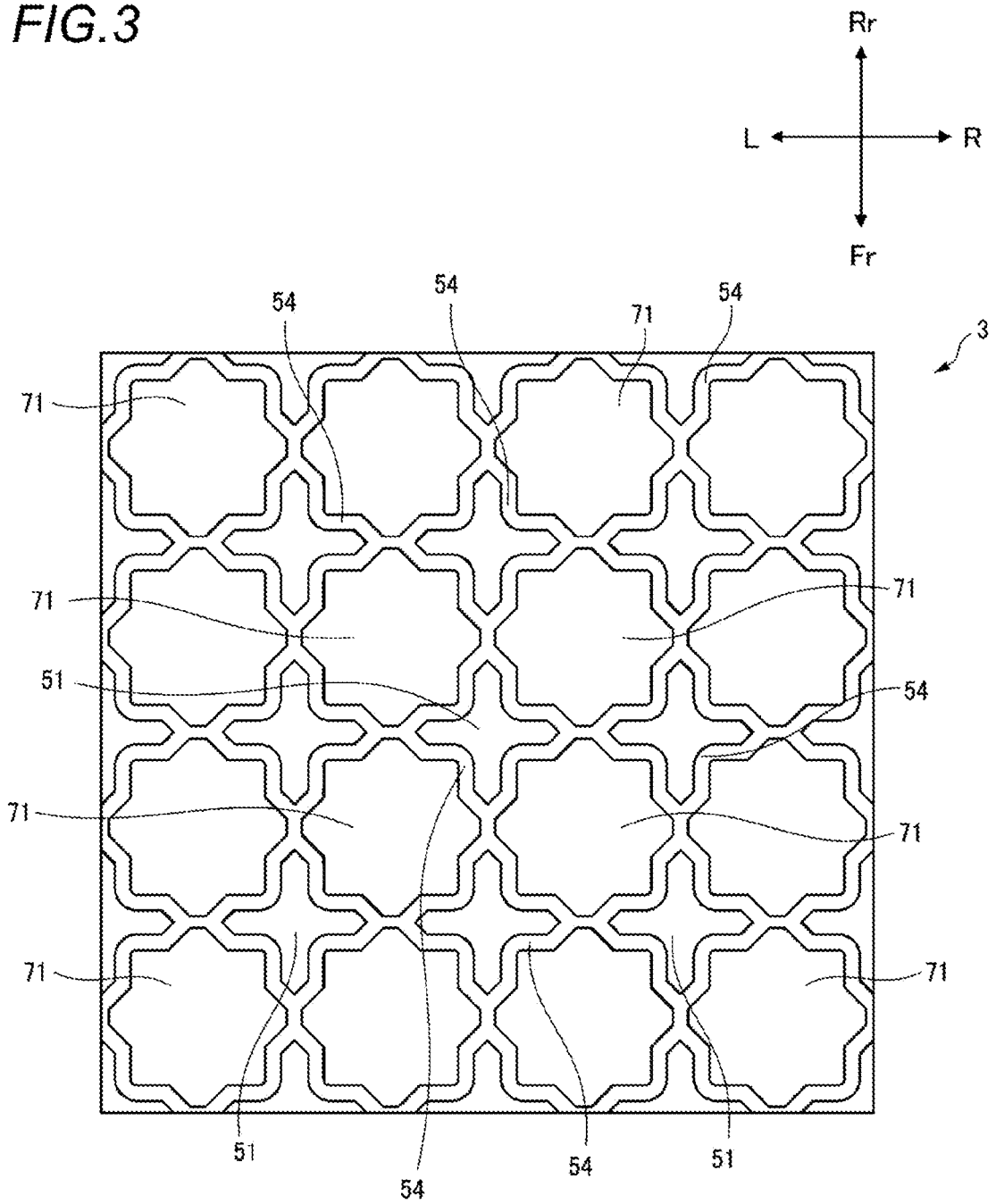
FIG. 3 is a partial cross-sectional view showing a part of a cross section taken along a line B-B in FIG. 1.

FIG. 1 is a perspective view of a radiator 1 according to an embodiment of the present invention. FIG. 2 is a partial perspective view of the radiator 1 of FIG. 1 in which a cross section taken along a line A-A in FIG. 1 is exposed. FIG. 3 is a partial cross-sectional view showing a part of a cross section taken along a line B-B in FIG. 1. In the present specification, in order to simplify and clarify the description, the radiator 1 will be described using an orthogonal coordinate system in three directions, that is, a front-rear direction, a left-right direction, and an upper-lower direction, as shown in FIG. 1. However, it should be noted that the direction is not related to a direction in which the radiator 1 is mounted on a device. In the drawings, an upper side is shown as U, a lower side is shown as D, a left side is shown as L, a right side is shown as R, a front side is shown as Fr, and a rear side is shown as Rr.

The radiator 1 includes a core portion 3, a first refrigerant flow path 5 provided in the core portion 3 and configured to allow cooling water to flow therethrough, and a second refrigerant flow path 7 provided in the core portion 3 and configured to allow air to flow therethrough. In the radiator 1, in the core portion 3, the cooling water flowing through the first refrigerant flow path 5 and the air flowing through the second refrigerant flow path 7 exchange heat via partition walls 54 to be described later. Therefore, there is a difference from a conventional plate type product in which a fluid is separated by a flat plate (heat transfer fins may be added), a fin tube type product in which heat is exchanged via heat conduction using flat plate fins around a circular tube, and the like. In the core portion 3, an introduction pipe 11 is provided on an upper portion of a rear surface, and a discharge pipe 13 is provided on a lower portion of a front surface. The introduction pipe 11 and the discharge pipe 13 communicate with the first refrigerant flow path 5 of the core portion 3.

As indicated by an arrow P, the cooling water is introduced into the core portion 3 from the outside through the introduction pipe 11 provided on the core portion 3, flows from above to below through the first refrigerant flow path 5 in the core portion 3, and then is discharged to the outside through the discharge pipe 13 provided on the core portion 3. On the other hand, as indicated by an arrow Q, the air is introduced into the core portion 3 from a lower surface of the core portion 3, flows from below to above through the second refrigerant flow path 7 in the core portion 3, and then is discharged from an upper surface of the core portion 3. The first refrigerant flow path 5 and the second refrigerant flow path 7 are regularly arranged tubular flow paths. Here, the tubular flow path refers to a pipe-like flow path having a closed cross-sectional shape of a circular arc or a polygon.

As shown in FIG. 2, the first refrigerant flow path 5 includes a plurality of first main flow paths 51 extending in an upper-lower direction and arranged in a front-rear direction, an introduction chamber 52 extending in the front-rear direction and communicating with the plurality of first main flow paths 51 arranged in the front-rear direction, and a discharge chamber 53 extending in the front-rear direction and communicating with the plurality of first main flow paths 51 arranged in the front-rear direction. In the first refrigerant flow path 5, when the plurality of first main flow paths 51 arranged in the front-rear direction and the introduction chamber 52 and the discharge chamber 53 that communicate with the first main flow paths 51 are defined as one set, a plurality of rows of these sets are provided in a left-right direction. Therefore, as shown in FIG. 3, the first main flow paths 51 are regularly arranged in a grid pattern in a cross section viewed from the upper-lower direction.

In the present embodiment shown in FIG. 3, the first main flow path 51 has a cross-shaped flow path cross section in which a space extending in the front-rear direction and a space extending in the left-right direction intersect in a cross shape. A shape of the first main flow path 51 is not limited thereto, and may be any shape such as a square, a rectangle, a diamond, a trapezoid, a circle, an ellipse, a star, a triangle, a polygon of pentagon or more, and other geometric patterns.

The introduction chamber 52 communicates with the introduction pipe 11, and the discharge chamber 53 communicates with the discharge pipe 13.

In the first main flow path 51, as shown in FIG. 2, an introduction side shape changing section 55 having a flow path cross-sectional shape gradually changing toward the introduction chamber 52 and linearly connected to the adjacent first main flow path 51 is provided at an upper end, and a discharge side shape changing section 56 having a flow path cross-sectional shape gradually changing toward the discharge chamber 53 and linearly connected to the adjacent first main flow path 51 is provided at a lower end.

The introduction side shape changing section 55 and the discharge side shape changing section 56 will be described later.

As shown in FIG. 3, the second refrigerant flow path 7 includes a plurality of second main flow paths 71 formed by being surrounded by the partition walls 54 that define the first main flow paths 51. The second main flow path 71 extends in the upper-lower direction, is surrounded by the first main flow paths 51 of the first refrigerant flow path 5, and is present in plurality in the front-rear direction and the left-right direction. Therefore, the plurality of second main flow paths 71 are regularly arranged in a grid pattern in the front-rear direction and the left-right direction in the cross section viewed from the upper-lower direction. That is, in the second refrigerant flow path 7, when the plurality of second main flow paths 71 extending in the upper-lower direction and arranged in the front-rear direction are defined as one set, a plurality of rows of these sets are provided in the left-right direction.

A lower end surface of the core portion 3 is formed with an introduction port 72 for introducing the air into each of the second main flow paths 71 arranged in a grid pattern in the front-rear direction and the left-right direction. An upper end surface of the core portion 3 is formed with a discharge port 73 for discharging the air flowing through each of the second main flow paths 71 arranged in a grid pattern in the front-rear direction and the left-right direction.

The air introduced into the introduction port 72 from below the core portion 3 passes through spaces between a plurality of discharge chambers 53 arranged in the left-right direction, and is introduced into a lower end of the second main flow path 71 of the second refrigerant flow path 7 from below.

The air introduced into the second main flow path 71 of the second refrigerant flow path 7 flows from below to above, passes through spaces between a plurality of introduction chambers 52 arranged in the left-right direction from an upper end of the second main flow path 71, and is discharged above the core portion 3 from the discharge port 73.

Hereinafter, the introduction side shape changing section 55 provided at the upper end of the first main flow path 51 of the first refrigerant flow path 5 will be described in detail with reference to FIGS. 4 to 7. Since the discharge side shape changing section 56 provided at the lower end of the first main flow path 51 of the first refrigerant flow path 5 has the same structure as that of the introduction side shape changing section 55, a detailed description thereof will be omitted.

The introduction side shape changing section 55 of the first main flow path 51 has the flow path cross-sectional shape gradually changing toward the introduction chamber 52 and is linearly connected to the adjacent first main flow path 51.

Figure 4:
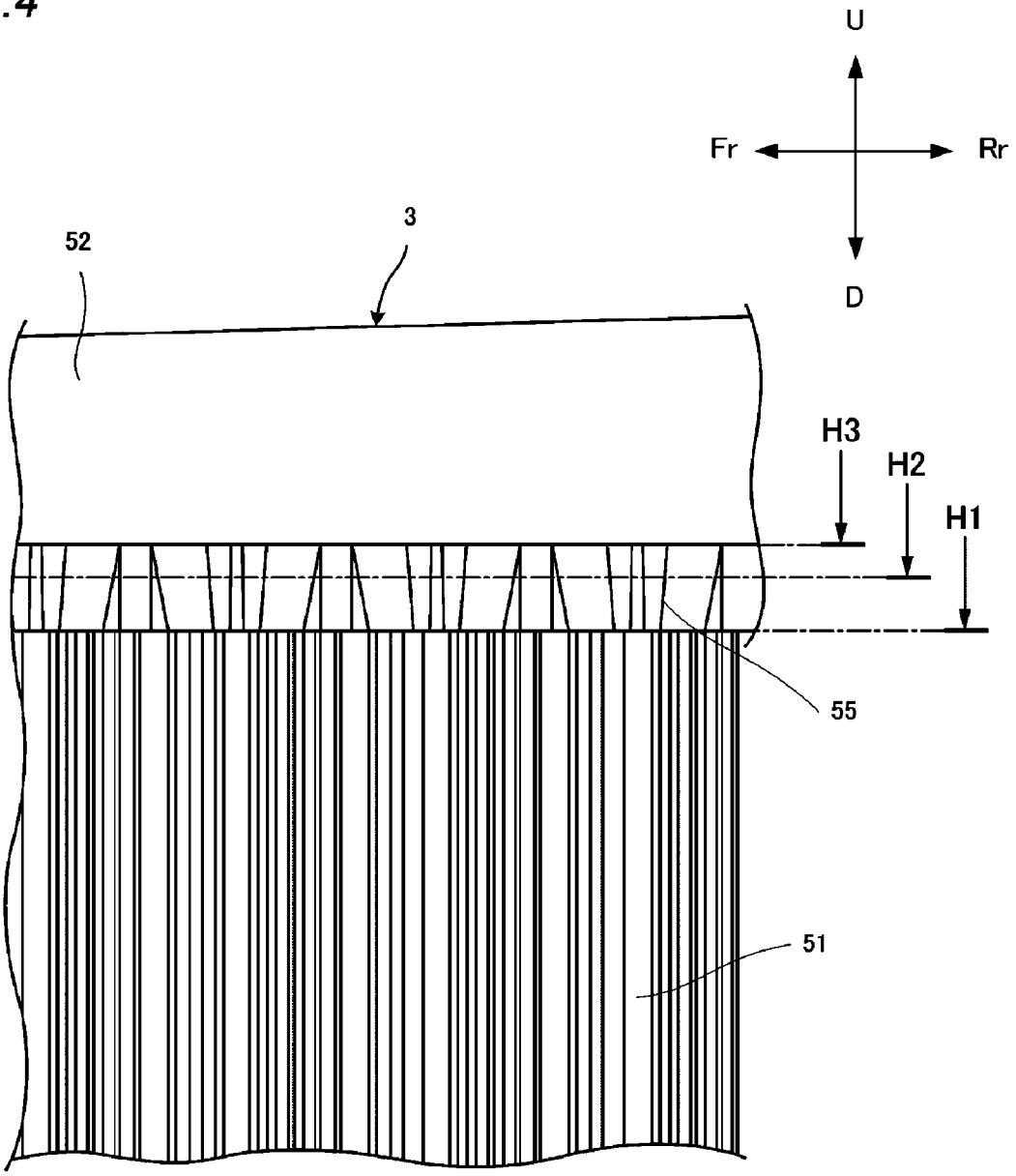
FIG. 4 is a view of a region D in FIG. 2 viewed from a direction C.
Figure 5:
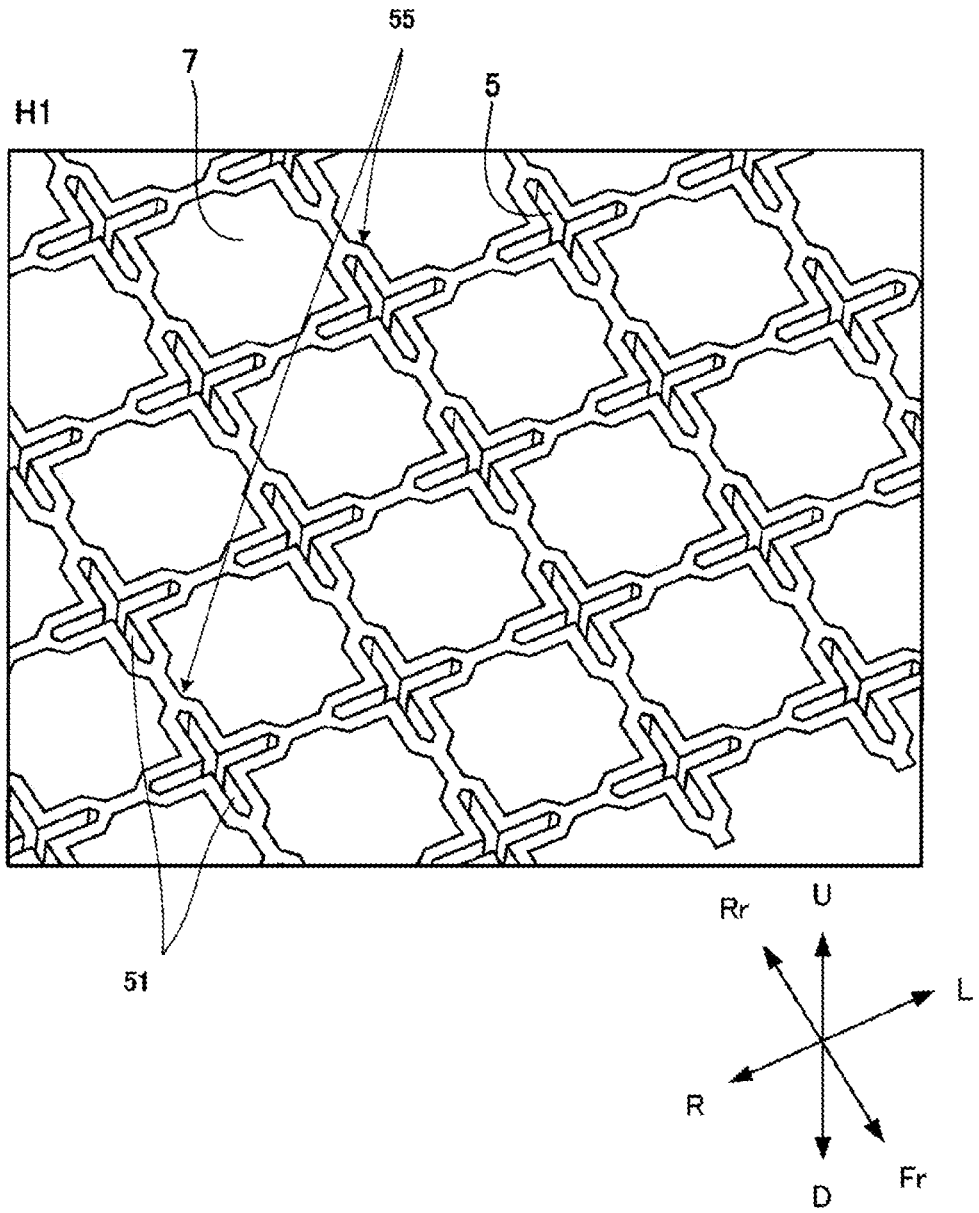
FIG. 5 is a partially enlarged view of a cross-sectional perspective view of the region D in FIG. 4 at an upper-lower direction position H1.
Figure 7:
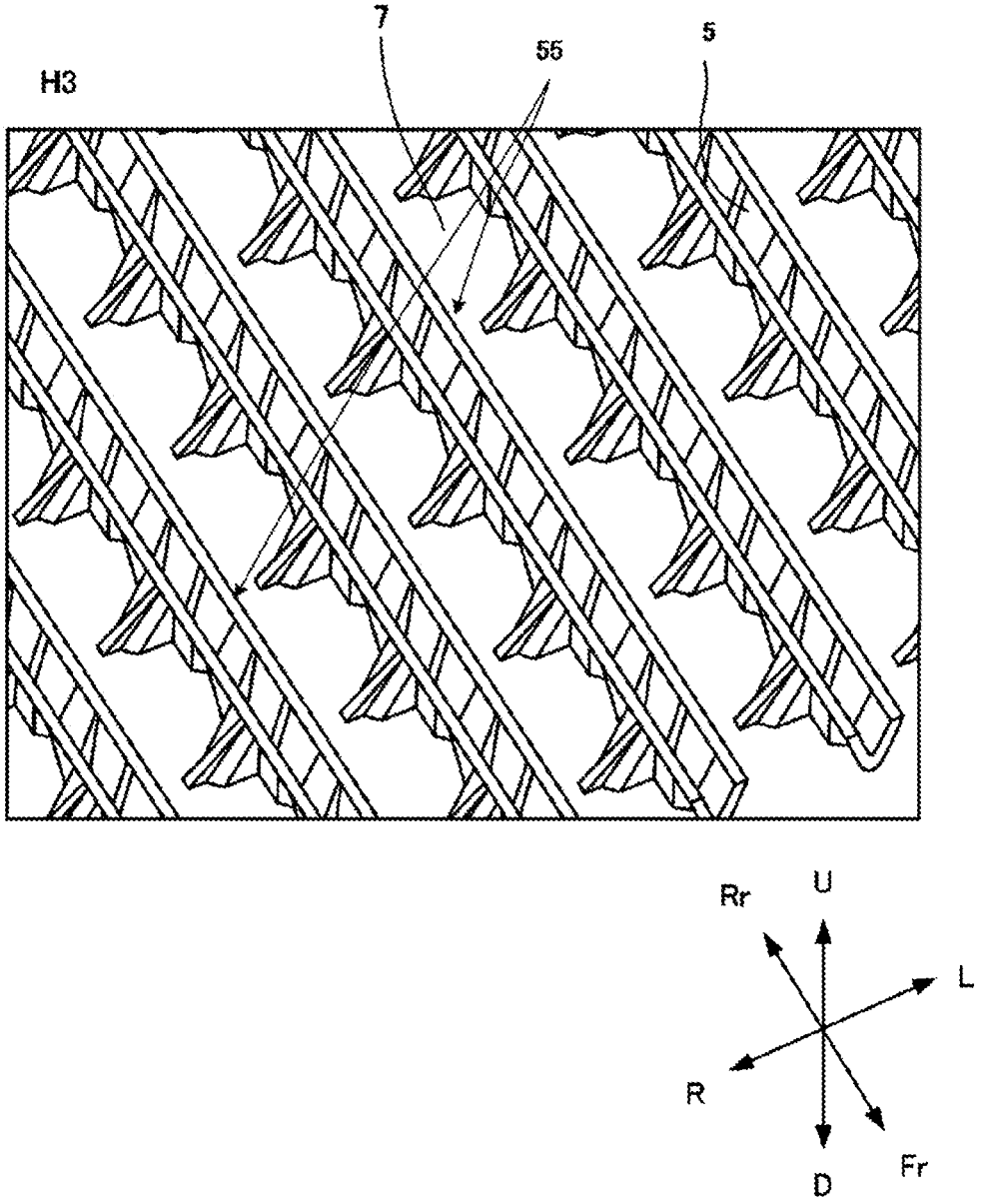
FIG. 7 is a partially enlarged view of a cross-sectional perspective view of the region D in FIG. 4 at an upper-lower direction position H3.
Figure 8:
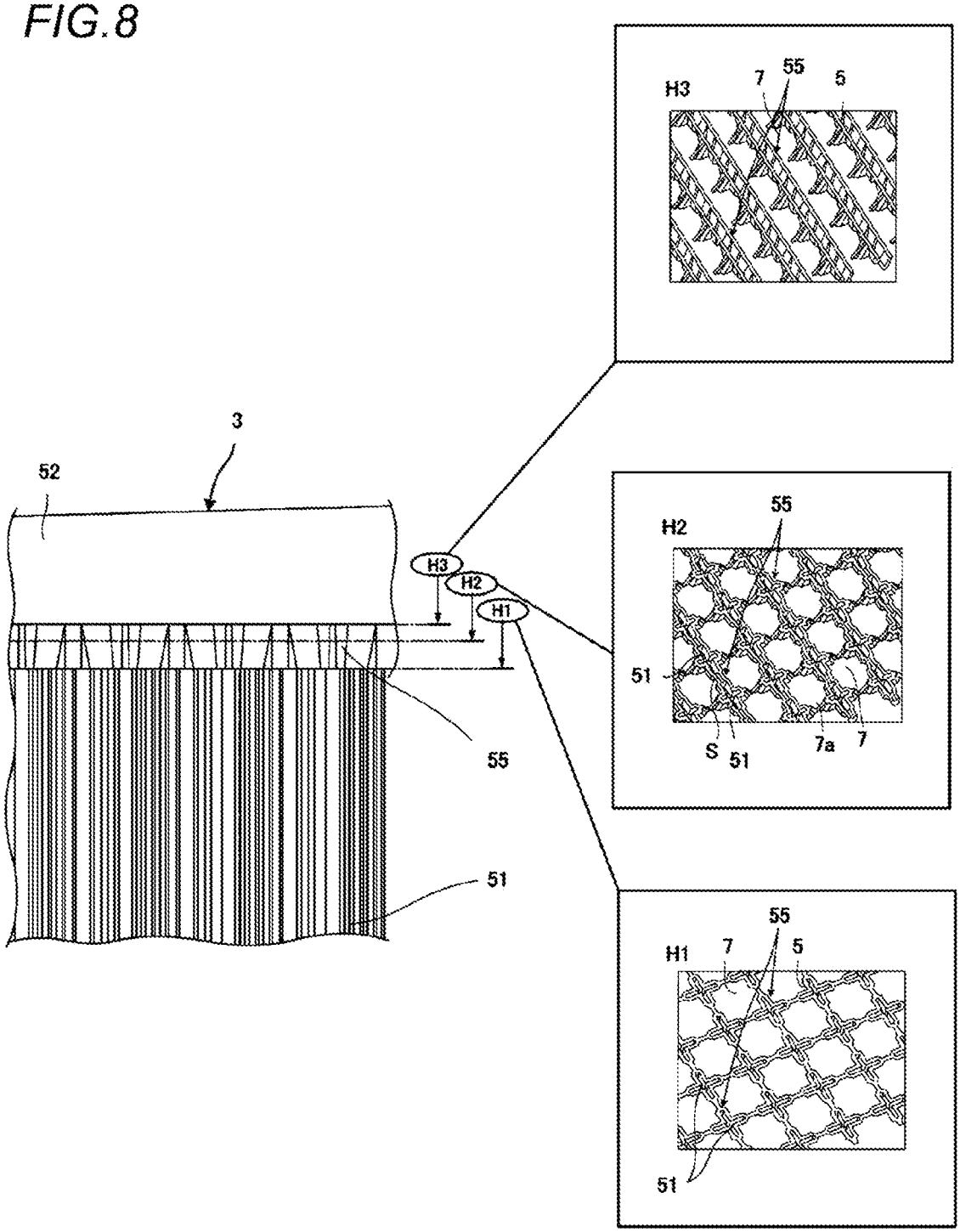
FIG. 8 is a view summarizing the cross-sectional perspective views of the region D in FIG. 4 at the upper-lower direction positions H1, H2, and H3.

FIG. 4 is a view of a region D in FIG. 2 viewed from a direction C. The region D is a region corresponding to upper ends of the first refrigerant flow path 5 and the second refrigerant flow path 7. FIG. 5 shows a partially enlarged view of a cross-sectional perspective view at an upper-lower direction position H1 in FIG. 4. Similarly, FIG. 6 shows a partially enlarged view of a cross-sectional perspective view at an upper-lower direction position H2 in FIG. 4, FIG. 7 shows a partially enlarged view of a cross-sectional perspective view at an upper-lower direction position H3 in FIG. 4, and FIG. 8 is a view summarizing the cross-sectional perspective views of the region D in FIG. 4 at the upper-lower direction positions H1, H2, and H3.

A partially enlarged view H1 shown in FIG. 5 shows an enlarged view at the lowermost upper-lower direction position H1 among the three enlarged views, and shows a start point of the introduction side shape changing section 55. At the upper-lower direction position H1, the first refrigerant flow path 5 has a shape shown in FIG. 3. That is, the first main flow path 51 of the first refrigerant flow path 5 has a cross-shaped flow path cross section. The first main flow paths 51 adjacent to each other in the front-rear direction and the left-right direction are independent of each other.

Figure 6:
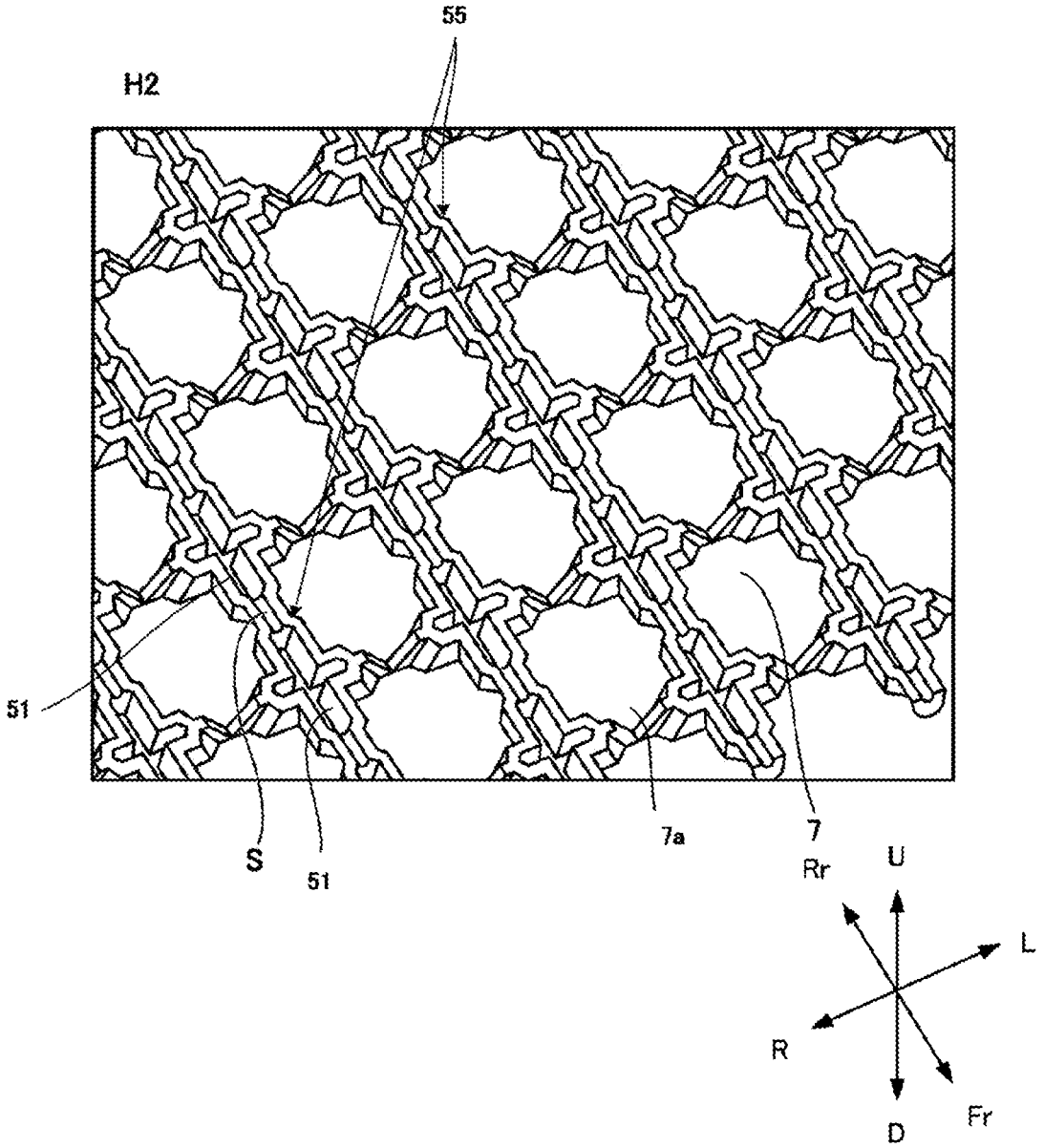
FIG. 6 is a partially enlarged view of a cross-sectional perspective view of the region D in FIG. 4 at an upper-lower direction position H2.

A partially enlarged view H2 shown in FIG. 6 shows an enlarged view at the middle upper-lower direction position H2 among the three enlarged views, and shows a middle part of the introduction side shape changing section 55. A flow path cross section at the upper-lower direction position H2 becomes wider as a length of a flow path extending in the front-rear direction becomes longer, and becomes narrower as a length of a flow path extending in the left-right direction becomes shorter from the cross-shaped flow path cross section (FIG. 5) at the upper-lower direction position H1 toward the introduction chamber 52 (upward). A communication path S is gradually provided between the first main flow paths 51 adjacent to each other in the front-rear direction. The flow path cross section at the upper-lower direction position H2 becomes wider as the length of the flow path extending in the front-rear direction becomes longer, and becomes narrower as the length of the flow path extending in the left-right direction becomes shorter further toward the introduction chamber 52 (upward).

Here, a cross-sectional area of the flow path cross section of the first main flow path 51 is the same in the introduction side shape changing section 55. That is, a flow path cross-sectional shape gradually changes in the introduction side shape changing section 55, but the cross-sectional area of the flow path cross section does not change. Therefore, the cooling water can flow more smoothly, and occurrence of a pressure loss is prevented.

A partially enlarged view H3 shown in FIG. 7 shows an enlarged view at the uppermost upper-lower direction position H3 among the three enlarged views, and shows an end point of the introduction side shape changing section 55. A flow path cross section at the upper-lower direction position H3 is connected to the adjacent first main flow path 51 and forms a straight line in the front-rear direction. That is, the communication path S cannot be distinguished from the flow path extending in the front-rear direction, and the flow path extending in the left-right direction disappears. The linear flow path shown in FIG. 7 communicates with the introduction chamber 52 located further above.

In this way, due to the introduction side shape changing section 55, the flow path cross section of the first main flow path 51 gradually changes and is linearly connected to the adjacent first main flow path 51, and communicates with the introduction chamber 52, so that a space having a predetermined width in the left-right direction and communicating with the plurality of second main flow paths 71 arranged in the front-rear direction extends in the front-rear direction between the introduction chambers 52 adjacent to each other in the left-right direction. Then, the air discharged from the second main flow path 71 of the second refrigerant flow path 7 is discharged to the outside from the discharge port 73 through this space, and does not hinder the flow of the air discharged from the second main flow path 71 of the second refrigerant flow path 7. Therefore, even if the introduction chamber 52 is disposed in a flow path space of the air from the discharge port 73 to the second main flow path 71, the flow of the air is not blocked.

Although the detailed description is omitted, similarly, the discharge side shape changing section 56 of the first main flow path 51 has the flow path cross-sectional shape gradually changing toward the discharge chamber 53 and is linearly connected to the adjacent first main flow path 51. In this way, due to the discharge side shape changing section 56, the flow path cross section of the first main flow path 51 gradually changes and is linearly connected to the adjacent first main flow path 51, and communicates with the discharge chamber 53, so that a space having a predetermined width in the left-right direction and communicating with the plurality of second main flow paths 71 arranged in the front-rear direction extends in the front-rear direction between the discharge chambers 53 adjacent to each other in the left-right direction. Then, the air introduced from the introduction port 72 is introduced into the second main flow path 71 of the second refrigerant flow path 7 through this space, and does not hinder the flow of the air introduced from the introduction port 72. Therefore, even if the discharge chamber 53 is disposed in a flow path space of the air from the introduction port 72 to the second main flow path 71, the flow of the air is not blocked.

In addition, in the introduction side shape changing section 55 and the discharge side shape changing section 56, by changing only the shape while maintaining the same cross-sectional area of the flow path cross section, it is possible to avoid an increase in the pressure loss of the cooling water.

Figure 9:
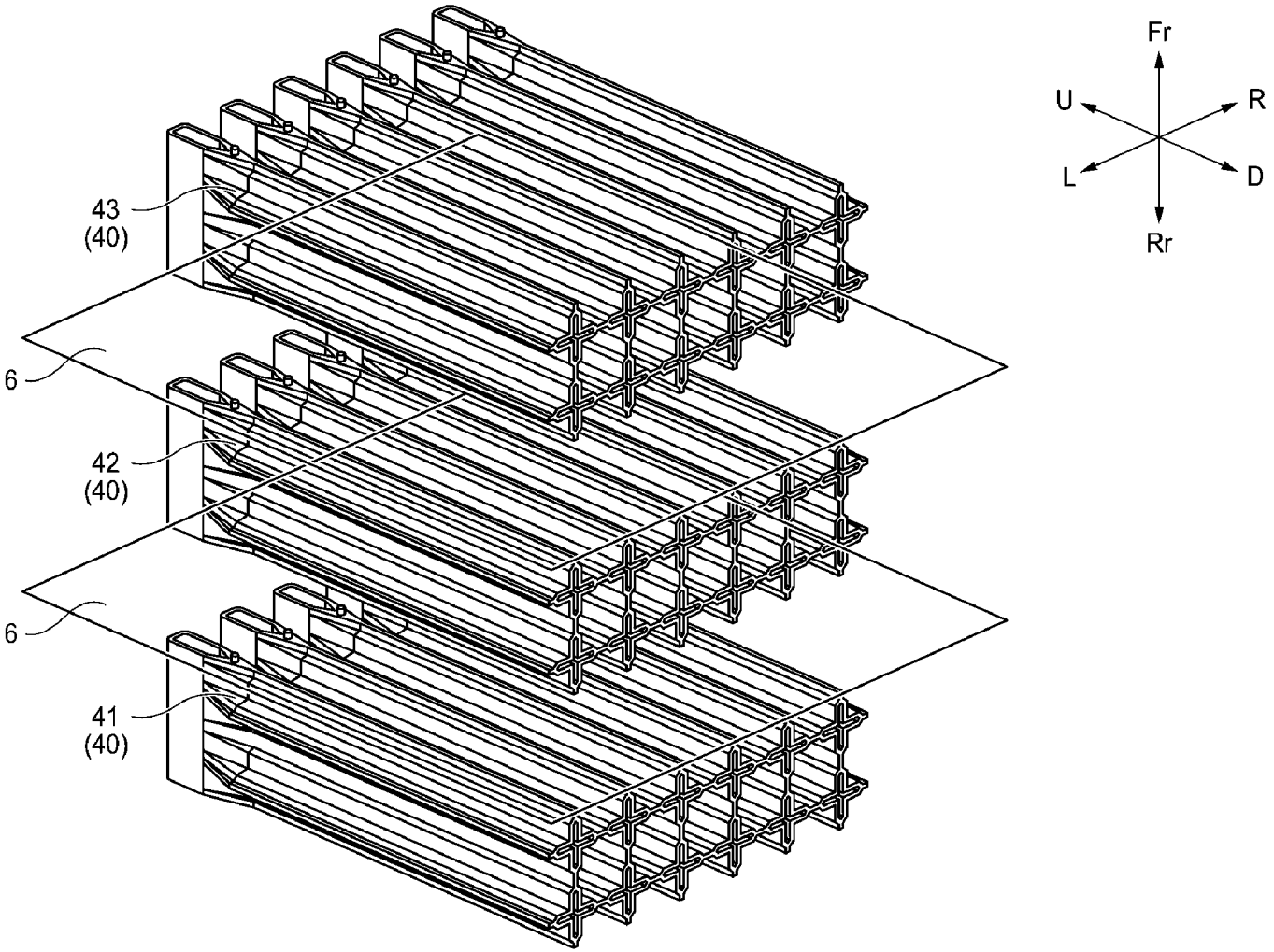
FIG. 9 is an exploded perspective view of a portion of the radiator 1 of FIG. 1 in which three units 40 are joined in a front-rear direction to form a core portion 3.

As shown in FIG. 9, the core portion 3 is formed by joining a plurality of units 40. FIG. 9 shows a portion in which three units 40 are joined in the front-rear direction to form the core portion 3. In the present embodiment, a first unit 41, a second unit 42, and a third unit 43 are arranged in this order from a rear side to a front side and joined in the front-rear direction. A brazing sheet 6 is interposed between joining surfaces of the units 40, and the joining surfaces of the units 40 are brazed with the brazing sheet 6, thereby joining the plurality of units 40.

Each unit 40 is formed by additive manufacturing a material. An additive manufacturing method of forming a shape by additive manufacturing a material is one of methods of manufacturing a three-dimensional shape. The additive manufacturing method is a manufacturing method of forming a member having a three-dimensional shape by laminating, based on a three-dimensional model, layers of a material corresponding to continuous cross sections of the three-dimensional model one by one. The additive manufacturing method is also known as a 3D printing technique. Unlike a conventional cutting process of forming a final product by performing cutting on a material block, the final product is formed by laminating a material in the additive manufacturing method, making it possible to form a complicated three-dimensional shape. The additive manufacturing method is also called an additive fabrication method, additive manufacturing, or an additive manufacturing (AM) technique.

In the additive manufacturing method, metal, ceramic, resin, or the like can be used as a material to be laminated. In the present embodiment, the unit 40 is formed of metal. The unit 40 may be formed of ceramic, resin, or the like.

Figure 10:
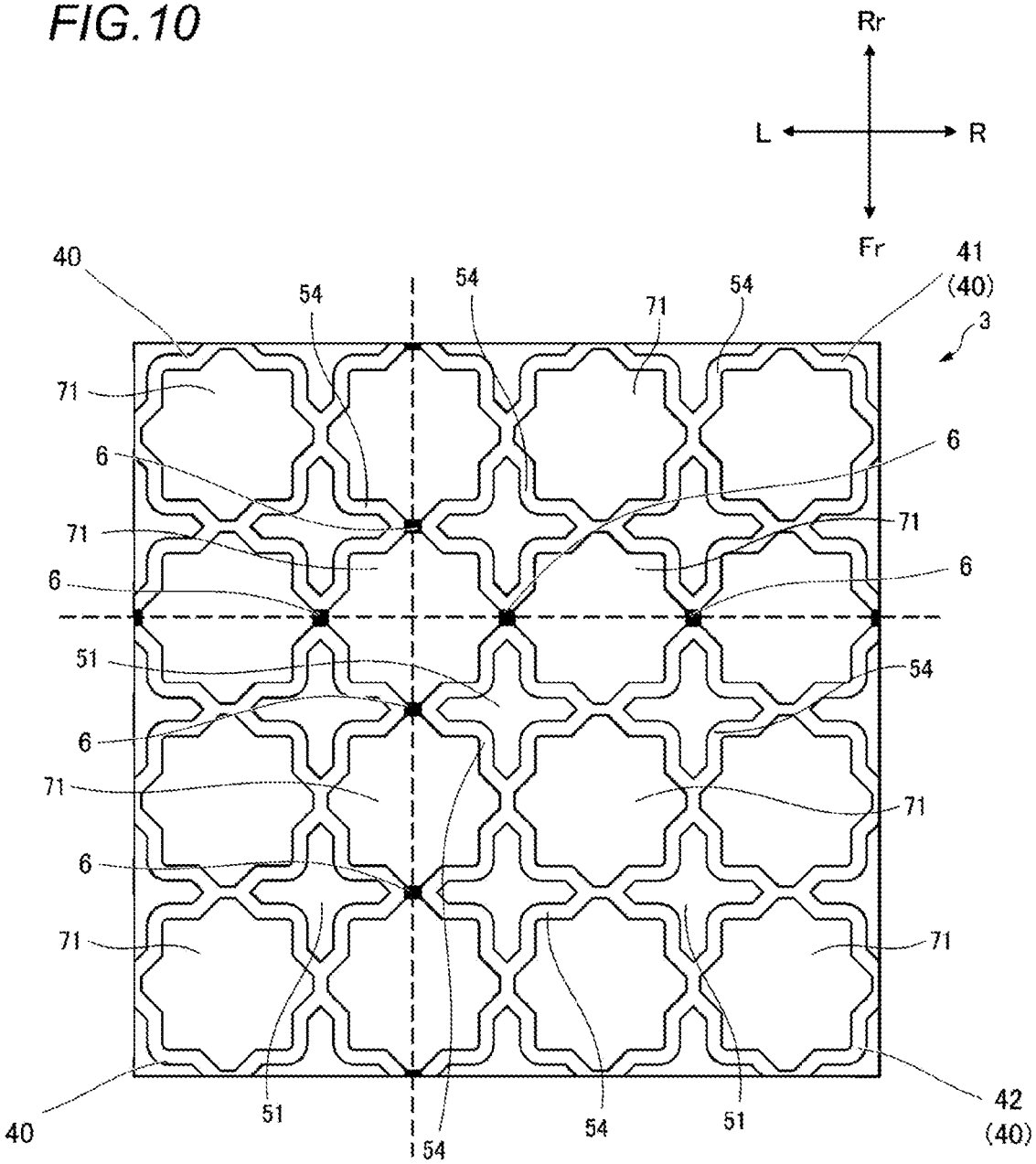
FIG. 10 is a partial cross-sectional view showing a part of a cross section taken along the line B-B in the vicinity of joining surfaces of a plurality of units 40 in the radiator 1 of FIG. 1.

As shown in FIG. 10, the first main flow path 51 of each of the units 40 is a region closed by the partition wall 54 in a cross section viewed from the upper-lower direction. On the joining surface of the unit 40 with the adjacent unit 40, the partition walls 54 forming the closed regions constituting the first main flow paths 51 are joined to each other by the brazing sheet 6.

As shown in FIG. 10, the core portion 3 is formed by joining a plurality of units 40 not only in the front-rear direction but also in the left-right direction as well as in the front-rear direction.

Accordingly, the first main flow paths 51 which are spaces closed by the partition walls 54 are joined to each other and the units 40 are joined to each other, and thus the first main flow path 51 and the second main flow path 71 do not communicate with each other even if a positional deviation occurs at the time of joining the units 40 or an error occurs in a dimension of the first main flow path 51 at the time of manufacturing the units 40. Therefore, the cooling water flowing through the first main flow path 51 and the air flowing through the second main flow path 71 are not mixed. Therefore, even if the positional deviation occurs at the time of joining the units 40 or an error occurs in the dimension of the first main flow path 51 at the time of manufacturing the units 40, the units 40 can be joined such that the cooling water flowing through the first main flow path 51 and the air flowing through the second main flow path 71 are not mixed, and thus the radiator 1 can be easily increased in size without deterioration in quality.

In particular, when the core portion 3 is integrally formed by the additive manufacturing method of forming a shape by additive manufacturing a material, there is a limit to an increase in size depending on a size of equipment or the like, and a manufacturing time becomes very long.

In the present embodiment, the plurality of units 40 can be formed by the additive manufacturing method of forming a shape by additive manufacturing a material, and then the plurality of units 40 can be joined to form the core portion 3, and thus by using the additive manufacturing method of forming a shape by additive manufacturing a material, it is possible to form a complicated shape, shorten the manufacturing time, and form the core portion 3 having an increased size without being limited by equipment.

Figure 11:
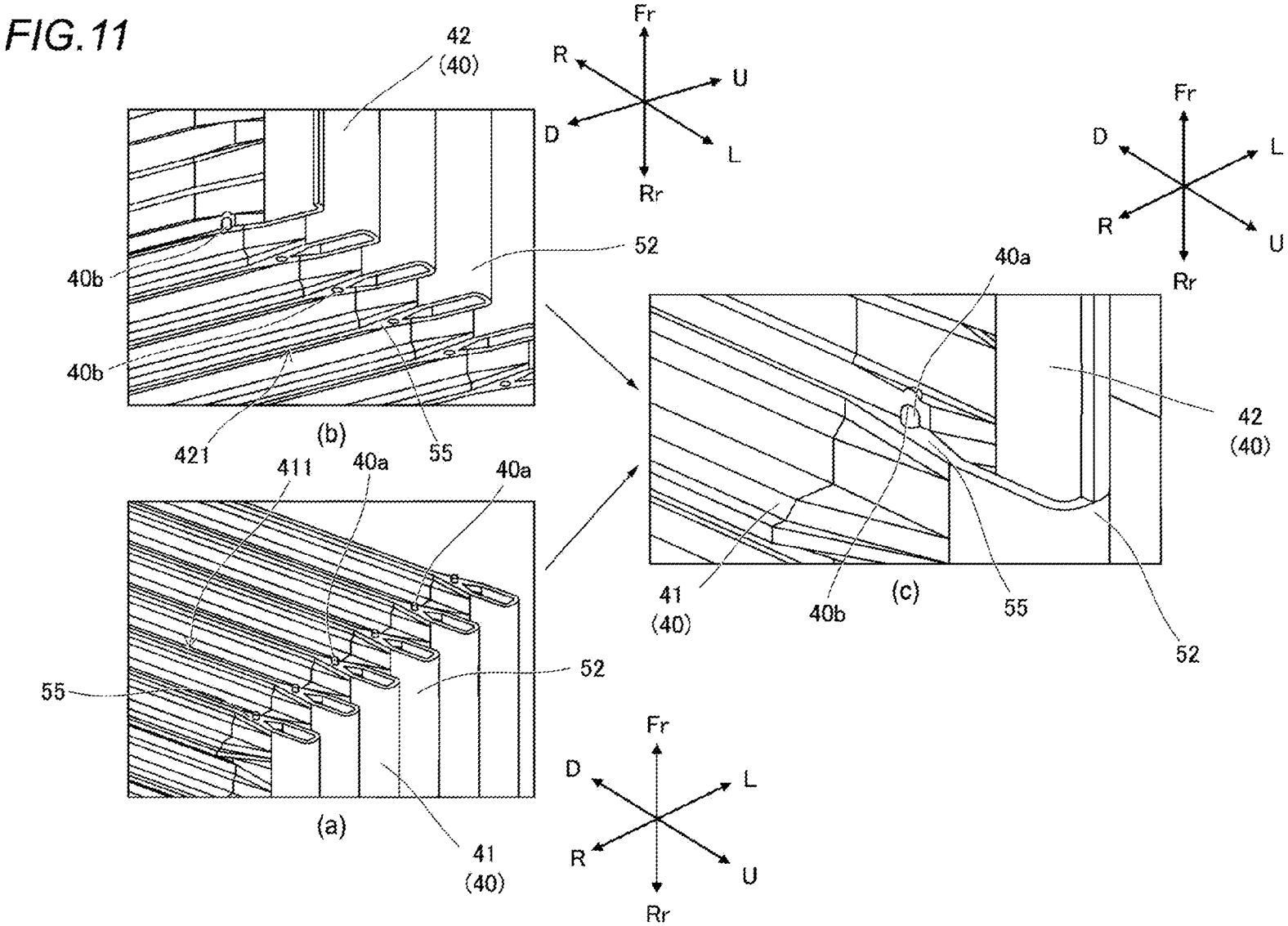
FIG. 11 is a drawing in which (a) is a partial perspective view of the vicinity of a positioning protrusion 40*a* formed on a joining surface 411 of a first unit 41 of FIG. 9, (b) is a partial perspective view of the vicinity of a positioning hole 40*b* formed in a joining surface 421 of a second unit 42 of FIG. 9, and (c) is a partial perspective view of the vicinity of the positioning protrusion 40*a* formed on the joining surface 411 of the first unit 41 and the positioning hole 40*b* formed on the joining surface 421 of the second unit 42 in a state in which the first unit 41 and the second unit 42 of FIG. 9 are joined.

FIG. 11 is an enlarged view of a joining surface 411 of the first unit 41 with the second unit 42 and a joining surface 421 of the second unit 42 with the first unit 41.

As shown in FIG. 11, the joining surface 411 of the first unit 41 with the second unit 42 and the joining surface 421 of the second unit 42 with the first unit 41 are surfaces perpendicular to the front-rear direction. In the present embodiment, the joining surface 411 of the first unit 41 with the second unit 42 is a front surface of the first unit 41, and the joining surface 421 of the second unit 42 with the first unit 41 is a rear surface of the second unit 42.

The joining surface 411 of the first unit 41 with the second unit 42 is provided with a positioning protrusion **40*a* protruding toward the joining surface 421 of the second unit 42 with the first unit 41. On the other hand, the joining surface 421 of the second unit 42 with the first unit 41 is provided with a positioning hole 40*b* into which the positioning protrusion 40*a* provided on the joining surface 411 of the first unit 41 can be fitted. The positioning protrusion 40*a* has a pin shape protruding toward the joining surface 421 of the second unit 42, and the positioning hole 40*b* has a recess shape into which the positioning protrusion 40*a*** can be fitted.

The brazing sheet 6 is interposed between the joining surface 411 of the first unit 41 with the second unit 42 and the joining surface 421 of the second unit 42 with the first unit 41, and the positioning protrusion **40*a* provided on the joining surface 411 of the first unit 41 is fitted into the positioning hole 40*b* provided in the joining surface 421 of the second unit 42, so that the joining surface 411 of the first unit 41 with the second unit 42 and the joining surface 421 of the second unit 42 with the first unit 41 are joined by the brazing sheet 6**.

When the first unit 41 and the second unit 42 are joined to each other, a positional deviation between the first unit 41 and the second unit 42 can be easily prevented by fitting the positioning protrusion 40*a* provided on the joining surface 411 of the first unit 41 into the positioning hole 40*b* provided in the joining surface 421 of the second unit 42. Accordingly, the first unit 41 and the second unit 42 can be joined while easily preventing the positional deviation.

Further, the positioning protrusion 40*a* provided on the joining surface 411 of the first unit 41 and the positioning hole 40*b* provided in the joining surface 421 of the second unit 42 are each formed in the region of the introduction side shape changing section 55.

In a cross section viewed from the front-rear direction, a width of the partition wall 54 in the left-right direction in the region forming the introduction side shape changing section 55 is larger than a width of the partition wall 54 in the left-right direction in the region forming the first main flow path 51.

Therefore, by providing each of the positioning protrusion 40*a* and the positioning hole 40*b* in the region of the partition wall 54 having a large width in the left-right direction, the positioning protrusion 40*a* and the positioning hole 40*b* can be easily provided without increasing the size of the core portion 3.

Although an embodiment of the present invention has been described above with reference to the accompanying drawings, it is needless to say that the present invention is not limited to the embodiment. It is apparent that those skilled in the art can conceive of various modifications and alterations within the scope described in the claims, and it is understood that such modifications and alterations naturally fall within the technical scope of the present invention. In addition, components in the above embodiment may be freely combined without departing from the gist of the invention.

For example, in the above embodiment, the radiator 1 including the core portion 3 having a box-like shape has been shown as an example, but the core portion 3 may have a complicated shape that is three-dimensionally curved by the additive manufacturing method.

In the present specification, at least the following matters are described. In parentheses, corresponding components and the like in the above embodiment are shown as an example, but the present invention is not limited thereto.

(1) A heat exchanger (radiator 1), including:
- a core portion (core portion 3);
- a first refrigerant flow path (first refrigerant flow path 5) provided in the core portion and configured to allow a first fluid (cooling water) to flow therethrough; and
- a second refrigerant flow path (second refrigerant flow path 7) provided in the core portion and configured to allow a second fluid (air) to flow therethrough, in which
- in the core portion, the first fluid flowing through the first refrigerant flow path and the second fluid flowing through the second refrigerant flow path exchange heat via a partition wall (partition wall 54),
- the first refrigerant flow path includes a plurality of first main flow paths (first main flow paths 51) extending in a first direction (upper-lower direction) and arranged in a second direction (front-rear direction) perpendicular to the first direction,
- the plurality of first main flow paths arranged in the second direction are provided in a plurality of rows arranged in a third direction orthogonal to both the first direction and the second direction,
- the second refrigerant flow path includes a plurality of second main flow paths (second main flow paths 71) extending in the first direction and arranged in the second direction,
- the plurality of second main flow paths arranged in the second direction are formed by being surrounded by the partition wall constituting the first main flow path, and are provided in a plurality of rows arranged in the third direction,
- the core portion is formed by joining a plurality of units (units 40), and
- the first main flow path of each of the units is a region closed by the partition wall in a cross section viewed from the first direction.

According to (1), the first main flow paths which are spaces closed by the partition walls are joined to each other and the units are joined to each other, and thus the first main flow path and the second main flow path do not communicate with each other even if a positional deviation occurs at the time of joining the units or an error occurs in a dimension of the first main flow path at the time of manufacturing the units. Therefore, the first refrigerant flowing through the first main flow path and the second refrigerant flowing through the second main flow path are not mixed. Therefore, even if the positional deviation occurs at the time of joining the units or an error occurs in the dimension of the first main flow path at the time of manufacturing the units, the units can be joined such that the first refrigerant flowing through the first main flow path and the second refrigerant flowing through the second main flow path are not mixed, and thus the heat exchanger can be easily increased in size without deterioration in quality.

(2) The heat exchanger according to (1), in which
- a joining surface (joining surface 411) of one unit with the other unit is provided with a positioning protrusion (positioning protrusion 40*a*) protruding toward a joining surface (joining surface 421) of the other unit with the one unit,
- the joining surface of the other unit with the one unit is provided with a positioning hole (positioning hole 40*b*) configured to allow the positioning protrusion provided on the joining surface of the one unit to fit, and
- the positioning protrusion provided on the joining surface of the one unit is fitted into the positioning hole provided in the joining surface of the other unit, so as to make the joining surface of the one unit with the other unit to join to the joining surface of the other unit with the one unit.

According to (2), when the two units are joined to each other, the positional deviation between the two units can be easily prevented by fitting the positioning protrusion provided on the joining surface of the one unit into the positioning hole provided in the joining surface of the other unit. Accordingly, the plurality of units can be joined while easily preventing the positional deviation.

(3) The heat exchanger according to (2), in which
- the first refrigerant flow path includes
- an introduction chamber (introduction chamber 52) provided at a first end (upper end) of the plurality of first main flow paths on one side in the first direction, communicating with the plurality of first main flow paths, and extending in the second direction, and a discharge chamber (discharge chamber 53) provided at a second end (lower end) of the plurality of first main flow paths on the other side in the first direction, communicating with the plurality of first main flow paths, and extending in the second direction, the first end of the first main flow path is formed with an introduction side shape changing section (introduction side shape changing section 55) having a predetermined flow path cross-sectional shape gradually changing toward the introduction chamber and linearly connected in the second direction to the adjacent first main flow path in the second direction, the second end of the first main flow path is formed with a discharge side shape changing section (discharge side shape changing section 56) having a predetermined flow path cross-sectional shape gradually changing toward the discharge chamber and linearly connected in the second direction to the adjacent first main flow path in the second direction, the joining surface of the one unit with the other unit and the joining surface of the other unit with the one unit are surfaces perpendicular to the second direction, and the positioning protrusion and the positioning hole are formed in at least one of the introduction side shape changing section and the discharge side shape changing section.

According to (3), by providing the positioning protrusion and the positioning hole in at least one of the introduction side shape changing section and the discharge side shape changing section in which a width of the partition wall is large, the positioning protrusion and the positioning hole can be easily provided without increasing a size of the core portion.

(4) A method for manufacturing the heat exchanger according to (1), the method including:

forming a plurality of the units by additive manufacturing a material; and joining the plurality of units to form the core portion.

According to (4), the plurality of units can be formed by additive manufacturing the material, and then the plurality of units can be joined to form the core portion, and thus by additive manufacturing the material, it is possible to form a complicated shape, shorten a manufacturing time, and form the core portion having an increased size without being limited by equipment.

REFERENCE SIGNS LIST

1: radiator (heat exchanger)
3: core portion
40: unit
411: joining surface
421: joining surface
5: first refrigerant flow path
51: first main flow path
52: introduction chamber
53: discharge chamber
54: partition wall
55: introduction side shape changing section
56: discharge side shape changing section
7: second refrigerant flow path
71: second main flow path

What is claimed is:

1. A heat exchanger comprising:

a core portion;

a first refrigerant flow path provided in the core portion and configured to allow a first fluid to flow therethrough; and a second refrigerant flow path provided in the core portion and configured to allow a second fluid to flow therethrough, wherein in the core portion, the first fluid flowing through the first refrigerant flow path and the second fluid flowing through the second refrigerant flow path exchange heat with each other via a partition wall, the first refrigerant flow path comprises a plurality of first main flow paths extending in a first direction and arranged in a second direction perpendicular to the first direction, the plurality of first main flow paths arranged in the second direction are provided in each of a plurality of rows arranged in a third direction orthogonal to both the first direction and the second direction, the second refrigerant flow path comprises a plurality of second main flow paths extending in the first direction and arranged in the second direction, the plurality of second main flow paths arranged in the second direction are formed by being surrounded by the partition wall constituting the first main flow path, and are provided in each of a plurality of rows arranged in the third direction, the core portion is formed by joining a plurality of units, the first main flow path of each of the plurality of units is a region closed by the partition wall in a cross section viewed from the first direction, a joining surface of one of the plurality of units with an other of the plurality of units is provided with a positioning protrusion protruding toward a joining surface of the other of the plurality of units with the one of the plurality of units, the joining surface of the other of the plurality of units with the one of the plurality of units is provided with a positioning hole configured to allow the positioning protrusion provided at the joining surface of the one of the plurality of units to be fitted into the positioning hole, the positioning protrusion provided at the joining surface of the one of the plurality of units is fitted into the positioning hole provided at the joining surface of the other of the plurality of units so that the joining surface of the one of the plurality of units with the other of the plurality of units is joined to the joining surface of the other of the plurality of units with the one of the plurality of units, the first refrigerant flow path comprises an introduction chamber provided at a first end of the plurality of first main flow paths on one side in the first direction, communicating with the plurality of first main flow paths, and extending in the second direction, and a discharge chamber provided at a second end of the plurality of first main flow paths on other side in the first direction, communicating with the plurality of first main flow paths, and extending in the second direction, the joining surface of the one of the plurality of units with the other of the plurality of units and the joining surface of the other of the plurality of units with the one of the plurality of units are surfaces perpendicular to the second direction, and the positioning protrusion and the positioning hole are provided in at least one of a connection portion between the plurality of first main flow paths and the introduction chamber or a connection portion between the plurality of first main flow paths and the discharge chamber.

2. The heat exchanger according to claim 1, wherein the first end of each of the plurality of first main flow paths is provided with an introduction side shape changing section that has a predetermined flow path cross-sectional shape gradually changing toward the introduction chamber and that is linearly connected, in the second direction, to the each of the plurality of first main flow paths, the second end of each of the plurality of first main flow paths is provided with a discharge side shape changing section that has a predetermined flow path cross-sectional shape gradually changing toward the discharge chamber and that is linearly connected, in the second direction, to the each of the plurality of first main flow paths, and the positioning protrusion and the positioning hole are provided in at least one of the introduction side shape changing section or the discharge side shape changing section.

3. A method for manufacturing the heat exchanger according to claim 1, the method comprising:

forming the plurality of units by additive manufacturing a material; and joining the plurality of units to form the core portion.

* * * * *